United States Patent [19]

Schweiger et al.

[11] Patent Number: 4,510,473

[45] Date of Patent: Apr. 9, 1985

[54] ELECTROMAGNETIC RELAY

[75] Inventors: Josef Schweiger; Bernhard Hering, both of Munich, Fed. Rep. of Germany

[73] Assignee: Siemens Aktiengesellschaft, Berlin & Munich, Fed. Rep. of Germany

[21] Appl. No.: 535,348

[22] Filed: Sep. 23, 1983

[30] Foreign Application Priority Data

Oct. 29, 1982 [DE] Fed. Rep. of Germany ..... 3240215

[51] Int. Cl.[3] ..... H01H 51/27

[52] U.S. Cl. ..... 335/86; 335/78; 335/151

[58] Field of Search ..... 335/78, 79, 80, 81, 335/82, 83, 84, 85, 86, 151, 153, 274, 270

[56] References Cited

U.S. PATENT DOCUMENTS 4,182,998 1/1980 Mueller et al. ..... 335/151

4,195,276 3/1980 Rauterberg ..... 335/151

*Primary Examiner*—Thomas H. Tarcza

*Assistant Examiner*—George Andrews

*Attorney, Agent, or Firm*—Hill, Van Santen, Steadman & Simpson

[57] ABSTRACT

An electromagnetic relay has a tongue armature disposed inside a hollow coil body substantially along the coil axis, the tongue armature having a free end movable between two cooperating pole plates and a fixed end secured to a carrier disposed in a recess in a flange of the coil body substantially perpendicular to the coil axis. The carrier includes a pair of adjustment plates which are connected by means of torsion stays to fastening tabs, the carrier being connected to the coil body at the fastening tabs. Adjustment of the tongue armature is undertaken after assembly of the relay by the application of an external magnetic field to the adjustment plates, the displacement of which permanently deforms the torsion stays so as to suitably position the tongue armature.

5 Claims, 3 Drawing Figures

ELECTROMAGNETIC RELAY

BACKGROUND OF THE INVENTION

1. Field of the Invention

The present invention relates to electromagnetic relays having a tongue armature disposed within a coil body extending substantially along the coil axis and mounted at one end with an opposite free end positioned for movement relative to at least one cooperating pole plate, and in particular to such a relay having a carrier at the fixed end of the tongue armature having a specified bending point for adjusting the position of the armature after assembly by means of an externally applied magnetic field.

2. Description of the Prior Art

An electromagnetic relay having a tongue armature disposed inside a coil body with a free end movable relative to at least one cooperating pole plate and having a fixed end connected to a carrier with a rated bending point in a form of a torsion stay between the point at which the armature is connected to the carrier and the point at which the carrier is in turn connected to the coil body is disclosed in German OS 2723219, corresponding to U.S. Letters Pat. No. 4,182,998. This relay has the advantage that the ferromagnetic adjustment plate, which is a part of the carrier plate, and the tongue armature connected to the carrier plate can be adjusted by an externally applied magnetic field even after the relay has already been enclosed in a housing and even after casting. In this conventional structure, the adjustment plate is disposed inside the hollow coil body parallel to the armature, requiring the diameter of the hollow interior of the coil body to be somewhat greater than would otherwise be necessary to accomodate the tongue armature alone. This is a disadvantage for miniature relays, however, wherein a design goal is to maintain the winding diameter, and thus the coil body, as small as possible in order to save space.

SUMMARY OF THE INVENTION

It is an object of the present invention to provide an electromagnetic relay which retains the advantage of magnetic adjustability by means of an externally applied magnetic field exhibited by conventional relay structures, but which permits further reduction of the coil diameter in ordr to permit further miniaturization of the relay.

The above object is inventively achieved in an electromagnetic relay wherein the adjustment plate is frontally disposed in one flange of the coil body at approximately a right angle relative to the coil axis, and is secured to the coil body flange by means of torsion stays so that the tongue armature connected thereto through the stays is positioned by permanent deformation of the stays which occurs upon the application of an external magnetic field to the adjustment plate.

The interior space requirement inside the coil body is reduced because the carrier is disposed frontally at a coil body flange, outside of the hollow coil interior, so that the coil winding diameter can also be reduced. Although such frontal placement of the adjustment plate requires slightly more space in the area of the coil flange, the additional space is negligible in comparison to the space saved in the vicinity of the coil winding.

In a preferred embodiment of the relay, the torsion stays are respectively connected to fastening tabs which are in turn securely connected to and rest frontally against the coil flange. The fastening tabs may be secured, for example, by means of deformed fastening lugs extending from the coil body. The adjustment plate is disposed in a recess of the coil body which is matched to the contour of the adjustment plate. In order to be exposed to as many magnetic field lines as possible during adjustment, the adjustment plate preferably occupies a significant portion of the end of the coil body. Additionally, the adjustment plate may be expanded at one end so as to assume a T-shape.

DESCRIPTION OF THE PREFERRED EMBODIMENTS

Figure 1:
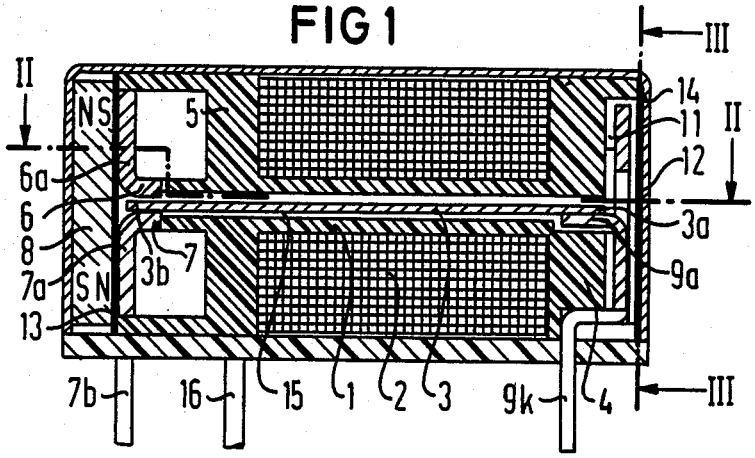
FIG. 1 is a sectional view of an electromagnetic relay constructed in accordance with the principles of the present invention taken along line I—I of FIG. 2.
Figure 2:
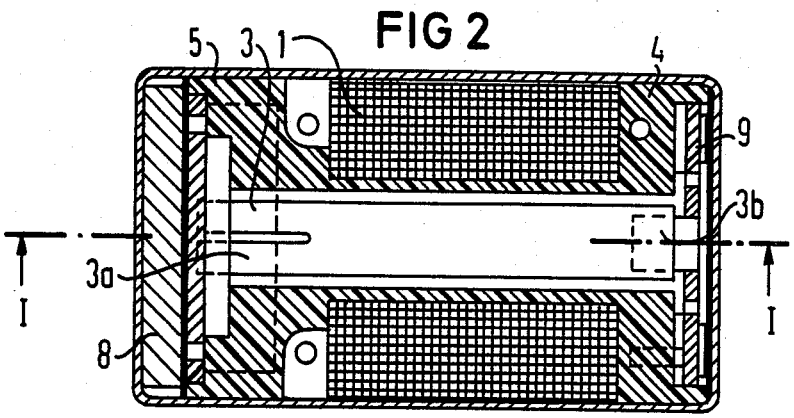
FIG. 2 is a sectional view of an electromagnetic relay constructed in accordance with the principles of the present invention taken along line II—II of FIG. 1.
Figure 3:
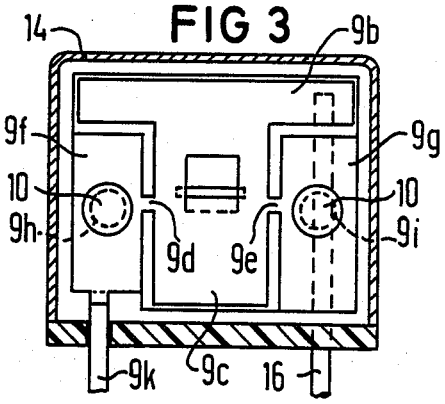
FIG. 3 is an end view of an electromagnetic relay constructed in accordance with the principles of the present invention taken along line III—III of FIG. 1.

The electromagnetic relay shown in the drawings has a coil body 1 comprised of insulating material and having a central portion with a winding 2. A spring-elastic tongue armature is disposed in the hollow interior of the coil body 1 substantially along the coil axis and is secured at a fixed end 3*a* in the area of one coil flange 4, and has a free end 3*b* movable between two cooperating pole plates 6 and 7 in the area of the opposite coil flange 5. The cooperating pole plates 6 and 7 have respective angled sections 6*a* and 7*a* which are coupled in a common plane to a four-pole permanent magnet 8.

A carrier 9 functions as a support for the tongue armature 3, and is disposed frontally at the coil flange 4 substantially perpendicular to the coil axis. The carrier 9 has an angled extension 9*a* extending in the direction of the coil axis to which the fixed end 3*a* of the tongue armature 3 is secured such as, for example, by means of a spot weld. The carrier 9 also functions as an adjustment plate and for this purpose has two adjustment tabs 9*b* and 9*c* which are interconnected to two fastening tabs 9*f* and 9*g* through respective torsion stays 9*d* and 9*e*. The fastening tabs 9*f* and 9*g* have respective bores 9*h* and 9*i* which receive fastening lugs 10 integrally formed on the coil body flange 4. After the tabs 9*f* and 9*g* are placed over the lugs 9, the lugs are thermally deformed to retain the carrier 9 in place. The carrier 9 consists of ferromagnetic material having a low spring flexion limit, preferably soft or pure iron. In order to adjust the tongue armature 3, a magnetic field is externally applied such that a torque is exerted on the two adjustment tabs 9*b* and 9*c*, and the torsion stays 9*d* and 9*e* are permanently deformed as a result thereof. With this deformation, the extension 9*a* rigidly connected to the adjustment tabs 9*b* and 9*c*, and the tongue armature 3 secured to the extension 9*a*, are simultaneously adjusted. As disclosed in the aforementioned U.S. Letters Pat. No. 4,182,998, the magnetic field must be applied such that the field lines obliquely strike the adjustment plate, that is, the adjustment tabs 9*b* and 9*c*. The field lines are preferably set at an angle relative to the adjustment tabs which is greater than 60° and less than 90°.

The adjustment tabs 9*b* and 9*c* are disposed in a recess 11 of the coil body flange 4 so that the adjustment tabs can be freely pivoted within the necessary range for adjustment. In order to intercept as many magnetic field lines as possible, the adjustment tabs 9*b* and 9*c* are designed so as to occupy substantially the entire end face of the coil body 1 with the exception of the area required by the fastening lugs 9*f* and 9*g*. The adjustment tab 9*b* in the embodiment shown in the drawings is therefore broadened so as to be T-shaped.

The interior volume 15 of the coil body 1 together with the recess 11 receiving the adjustment tabs 9*b* and 9*c* is covered by a film 12, with the other end of the coil body 1 being covered by a film 13 covering the pole plate sections 6*a* and 7*a*. The films 12 and 13 serve as a preliminary cover in order to ensure during casting of the relay in a ferromagnetic cap 14 that no casting compound penetrates to the inside volume 15 of the coil body 1. At the same time, the films 12 and 13 serve as electrical insulation, which is necessary because the tongue armature 3 and the cooperating pole plates 6 and 7 also simultaneously function as electrical contacts. Accordingly the cooperating poles plates 6 and 7 are respectively provided with integrally formed terminal pins 6*b* and 7*b*, and a terminal pin 9*k* for the tongue armature 3 is formed on the character 9. Terminal pins 16 for the coil winding 2 are also embedded in the coil body 1 in a known manner. All terminal pins are either originally disposed for standard module mounting or may be bent into such a standard format.

The ferromagnetic cap 14 functions both for guiding the permanent magnetic flux as well as the excitation flux, coupling between the carrier 9 and the cap 14 being relatively good despite the air gap existing due to the large surface of the adjustment tabs 9*b* and 9*c* and the fastening tabs 9*f* and 9*g*.

Although modifications and changes may be suggested by those skilled in the art it is the intention of the inventors to embody within the patent warranted hereon all changes and modifications as reasonably and properly come within the scope of their contribution to the art.

We claim as our invention:

1. An electromagnetic relay comprising:

a hollow coil body having two end flanges and a central section therebetween about which a coil having a coil axis is wound;

at least one pole piece disposed at one of said flanges;

a tongue armature extending through said coil body substantially along said coil axis having a free end movable relative to said pole piece and a fixed end;

a carrier plate disposed substantially perpendicular to said coil axis at the other end of said coil flanges to which said fixed end of said tongue armature is attached, said carrier plate having a magnetically displaceable adjustment plate; and a securing means rigidly connecting said carrier plate to said coil body including torsion stay means connected to said adjustment plate, whereby the position of said tongue armature relative to said pole plate may be adjusted by the application of an external magnetic field to said adjustment plate for displacing said adjustment plate and permanently deforming said torsion stay means.

2. A relay as claimed in claim 1 wherein said securing means includes fastening tabs rigidly connected to said coil body in substantially the same plane as said carrier plate, and respectively connected to said torsion stay means.

3. A relay as claimed in claim 2 wherein said fastening tabs respectively have bores therein and wherein said securing means further comprises deformable lugs extending from said coil body in registry with said bores.

4. A relay as claimed in claim 1 wherein said other coil body flange has a recess and wherein said carrier plate and said adjustment plate are disposed in said recess.

5. A relay as claimed in claim 1 wherein said adjustment plate has a T-shaped section at one end thereof.

* * * * *